US006699145B2

(12) United States Patent
Scott

(10) Patent No.: US 6,699,145 B2
(45) Date of Patent: Mar. 2, 2004

(54) APPARATUS AND METHOD FOR CURLING AND TOOLS

(76) Inventor: Robert S. Scott, S8950 Stonebrook Dr., Eleva, WI (US) 54738

( * ) Notice: Subject to any disclaimer, the term of this patent is extended or adjusted under 35 U.S.C. 154(b) by 0 days.

(21) Appl. No.: 10/050,333

(22) Filed: Jan. 15, 2002

(65) Prior Publication Data

US 2003/0134699 A1 Jul. 17, 2003

(51) Int. Cl.[7] ..... A63B 67/00
(52) U.S. Cl. ..... 473/465; 473/587; 15/246
(58) Field of Search ..... 473/465, 587; 294/58; 16/426, 429, 110.1, 406, 422; 15/246

(56) References Cited

U.S. PATENT DOCUMENTS

| | | | | | |
|---|---|---|---|---|---|
| 85,956 | A | * | 1/1869 | Pinkham | 15/246 |
| 933,647 | A | * | 9/1909 | Hunt | 294/58 |
| 4,198,090 | A | * | 4/1980 | Gutman | 294/58 |
| 4,638,522 | A | * | 1/1987 | Robertson | 15/160 |

OTHER PUBLICATIONS

Layne Kennedy, Figure 2 of Application showing Prior Art of Apparatus, Date unknown.

Allsport, Figure 3 of Application showing Prior Art of Apparatus, Date unknown.

* cited by examiner

*Primary Examiner*—Paul T. Sewell
*Assistant Examiner*—M. Chambers
(74) *Attorney, Agent, or Firm*—Skinner and Associates

(57) ABSTRACT

A curling broom, comprises a broom head, a broom handle attached to the broom head, and a delivery accessory adapted for attachment to either the broom handle or the broom head in both a first position and a second position. The delivery accessory improves the balance of a person delivering a curling stone in the first position. The delivery accessory is stored in a nonobtrusive manner in the second position enabling the curling broom to be used for conventional sweeping in front of a delivered curling stone. The delivery accessory for comprises a support stand and a mount adapted for attaching the support stand to the curling broom. The accessory is also useable with tools such as shovels, rakes, and the like. A method for delivering a curling stone is also disclosed. The method comprises the steps of attaching a delivery accessory to a curling broom, and delivering the curling stone with one hand and holding onto the curling broom with a second hand as the curling stone is being delivered.

6 Claims, 8 Drawing Sheets

APPARATUS AND METHOD FOR CURLING AND TOOLS

37 C.F.R. §1.71(e) AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. The copyrighted images credited to other parties are used to illustrate the sport of curling in support of the disclosure is this patent application and are believed to be a Fair Use under 17 U.S.C. §107.

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention.

The present invention relates, generally, to athletic equipment and methods, and particularly to equipment and methods used in the sport of curling. More particularly, the invention relates to an apparatus and method for maintaining or improving balance during the delivery of a curling stone. The apparatus and methods are also useful with tools or other devices which have handles.

2. Background Information

The state of the art includes various devices and methods for maintaining balance during the delivery of a curling stone. These include conventional curling brooms and a separate and distinct stabilizer.

The known devices and methods are believed to have significant limitations and shortcomings. Specifically, it may be difficult for some people to maintain their balance with a conventional curling broom. Further, the separate and distinct stabilizers may be misplaced or may be left in inconvenient locations on the curling rink between deliveries.

The present invention provides an apparatus and method for delivering a curling stone which are believed to constitute an improvement over the known art.

The invention also provides an apparatus and method for use with tools such as shovels, rakes and the like, which are believed to constitute an improvement of the known art.

BRIEF SUMMARY OF THE INVENTION

The present invention provides an apparatus and method for delivering a curling stone. The apparatus of the present invention may be defined as either a curling broom or as a delivery accessory for a curling broom. The curling broom generally comprises a broom head, a broom handle attached to the broom head, and a delivery accessory adapted for being attached to either the broom handle or the broom head in both a first position and a second position. The delivery accessory provides a means for improving the balance of a person delivering a curling stone in the first position. The delivery accessory is stored in a nonobtrusive manner in the second position enabling the curling broom to be used for conventional sweeping in front of a delivered curling stone. The delivery accessory generally comprises a support stand and a mount adapted for attaching the support stand to the curling broom. In an alternative embodiment, the delivery accessory may include a friction cam adapted for locking into a usable orientation in the first position, releasing to slide along the broom handle, and locking into a stored orientation in the second position. The method for delivering a curling stone generally comprises the steps of attaching a delivery accessory to a curling broom, and delivering the curling stone with one hand and holding onto the curling broom with a second hand as the curling stone is being delivered.

The invention also provides a tool, comprising, generally, a head element; a handle attached to the head element; and a delivery accessory adapted for being attached to the handle in either a first or a second position. The delivery accessory improves the balance and work output of a person using the tool when the delivery accessory is in the first position. The delivery accessory is stored in a nonobtrusive manner in the second position.

The features, benefits and objects of this invention will become clear to those skilled in the art by reference to the following description, claims, and drawings.

DETAILED DESCRIPTION

Figure 1:
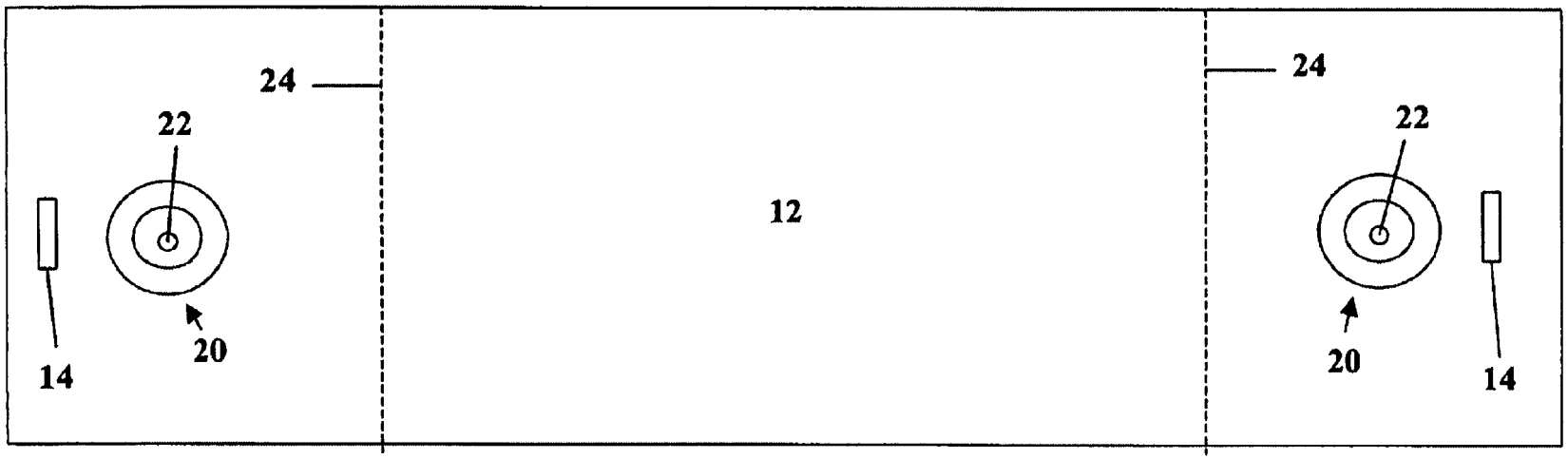
FIG. 1 is an illustration of a curling rink.

The sport of curling is played on an ice rink 12, as generally illustrated in FIG. 1. Each end of the rink 12 includes a hack 14, which is an indentation in the ice, from which the players 16 can push off from the deliver the approximately forty-two pound stone 18. In front of each hack 14 is a house 20 comprised of a set of concentric rings. At the center of the house 20 is the button 22 which serves as the target when delivering the stone 18 from the opposing hack 14. A hog line 24 is positioned on the other side of the house. When delivering a stone 18, the player 16 moves or slides forward from the hack 14 with the stone 18. The player 16 must release the stone 18 before crossing the first hog line 24, and the released stone 18 must cross the second hog line 24. When the stone 18 is delivered or thrown, it is rotated slightly. The ice surface is pebbled with small bumps of ice all over the surface, which causes the stone to curl or veer off in the direction of the spin.

A team has four players, and each player delivers two stones 18 per end. The players on the teams throws alternately. The team with the stone(s) 18 in the house 20 closest to the center or button 22 scores for the end. The number of points scored is the total number of the one team's stones 18 that are closer to the button 22 than the closed of the opponents' stones.

Figure 3:
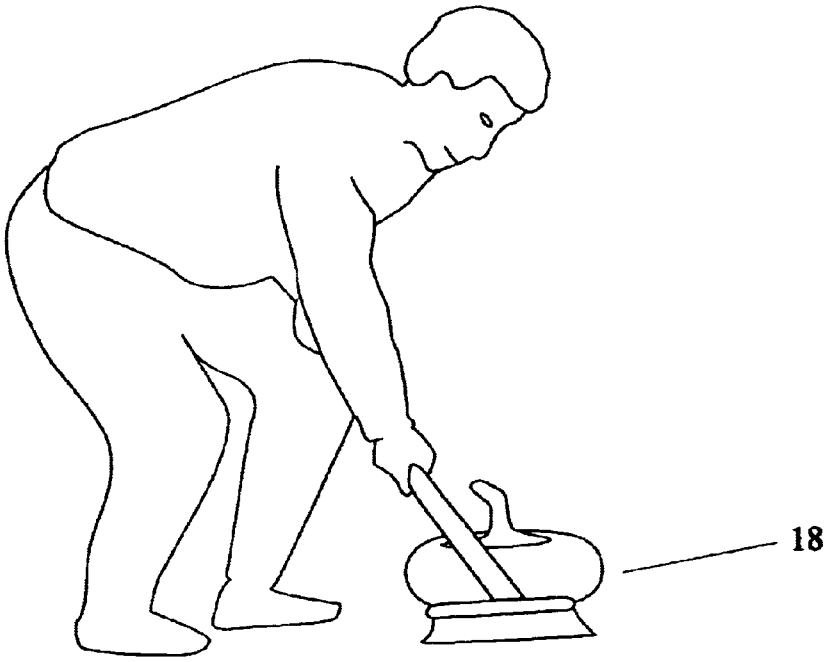
FIG. 3 is an image illustrating the use of curling brooms to sweep in front of a curling stone.

All four teammates participate in each stone thrown by the team. One calls the shot, one delivers it and two sweep in front of the stone with their curling brooms 30. Sweeping the ice in front the moving stone temporarily melts the ice and thereby reduces friction for the stone, which causes the stone to travel farther and curl less than it would otherwise. FIG. 3 illustrates this sweeping motion by two of the team members.

Figure 2:
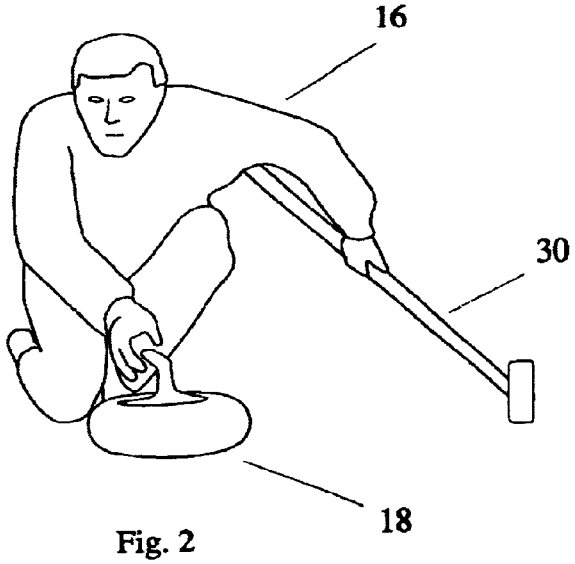
FIG. 2 is an image illustrating the use of a conventional broom to maintain balance while delivering a curling stone.
Figure 4:
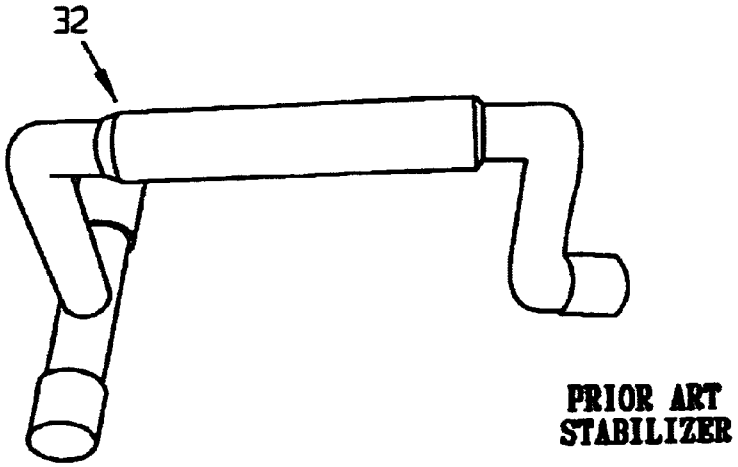
FIG. 4 is an illustration of a known stabilizer used in place of a conventional broom to maintain balance while delivering a curling stone.
Figure 5:
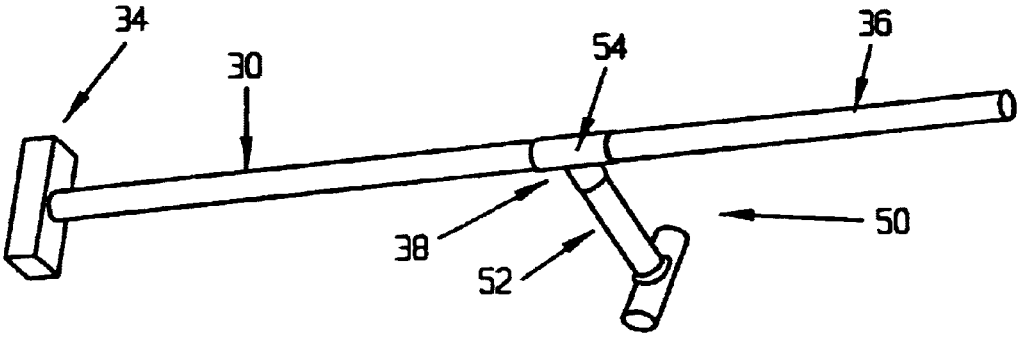
FIGS. 5 and 7 are views of a curling broom with a delivery accessory in a first, use position enabling the broom to be used to maintain balance while delivering a curling stone.
Figure 6:
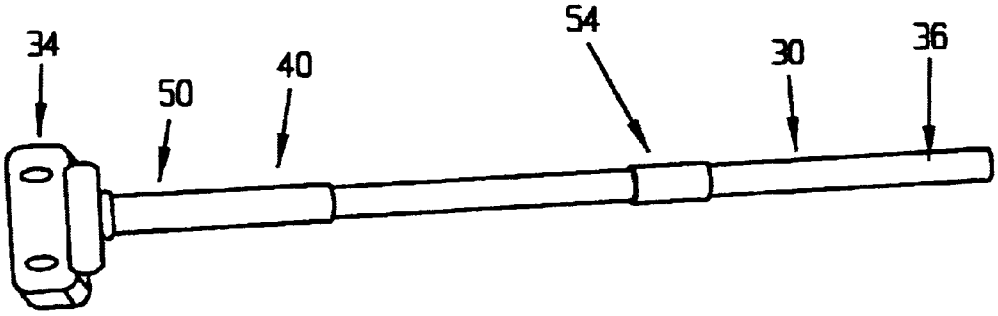
FIGS. 6 and 9 are views of a curling broom with a delivery accessory in a second, non-use or stored position enabling the broom to be used to sweep in front of the curling stone.

Because of the weight of the stone 18 and the slippery surface of the rink 12, it can be difficult to maintain the balance required to accurately deliver the stone 18. FIG. 2 illustrates a conventional method of delivering a stone 18 in which a player 16 maintains his balance with a conventional broom 30. Alternatively, some players use the stabilizer 32 shown in FIG. 4. However, the use of this separate and distinct stabilizer is not always accepted approvingly by the more traditional curling players. Additionally, a separate and distinct stabilizer may be misplaced or left in an inconvenient location such as the other side of the rink 12.

U.S. Provisional Patent application No. 60/210,151 filed Jun. 7, 2000 entitled Apparatus and Method for Delivering a Curling Stone is hereby incorporated by reference.

Referring to FIGS. 5–9, an example of the preferred embodiment of the present invention is illustrated. The invention provides an apparatus and method for delivering a curling stone 18. The apparatus may be defined as either a curling broom 30, or as a delivery accessory 50 for a curling broom 30. The curling broom 30 generally comprises a broom head 34, a broom handle 36 attached to the broom head 34, a broom handle 36 attached to the broom head 34, and a delivery accessory 50 adapted for being attached to either the broom handle 36 or the broom head 34 in both a first position 38 and a second position 40. The delivery accessory 50 provides a means for improving the balance of a player 16 delivering a curling stone 18 in the use or first position 38. The delivery accessory 50 is stored in a non-obtrusive manner in the non-use or second position 40 enabling the curling broom 30 to be used for conventional sweeping in front of a delivered curling stone 18. The delivery accessory 50 generally comprises a support stand 52 and a mount 54 adapted for attaching the support stand 52 to the curling broom 30.

In one embodiment, the delivery accessory 50 is adapted for being attached to the broom handle 36 in the first position 38 via a mount 54 and in the second position 40, for storage. An alternative position would be to store the delivery accessory 50 by inserting it into an end opening in the broom handle 36. The delivery accessory 50 may have an adjustable length, and further may be adapted for being adjustably attached along the length of the broom handle 36.

Figure 7:
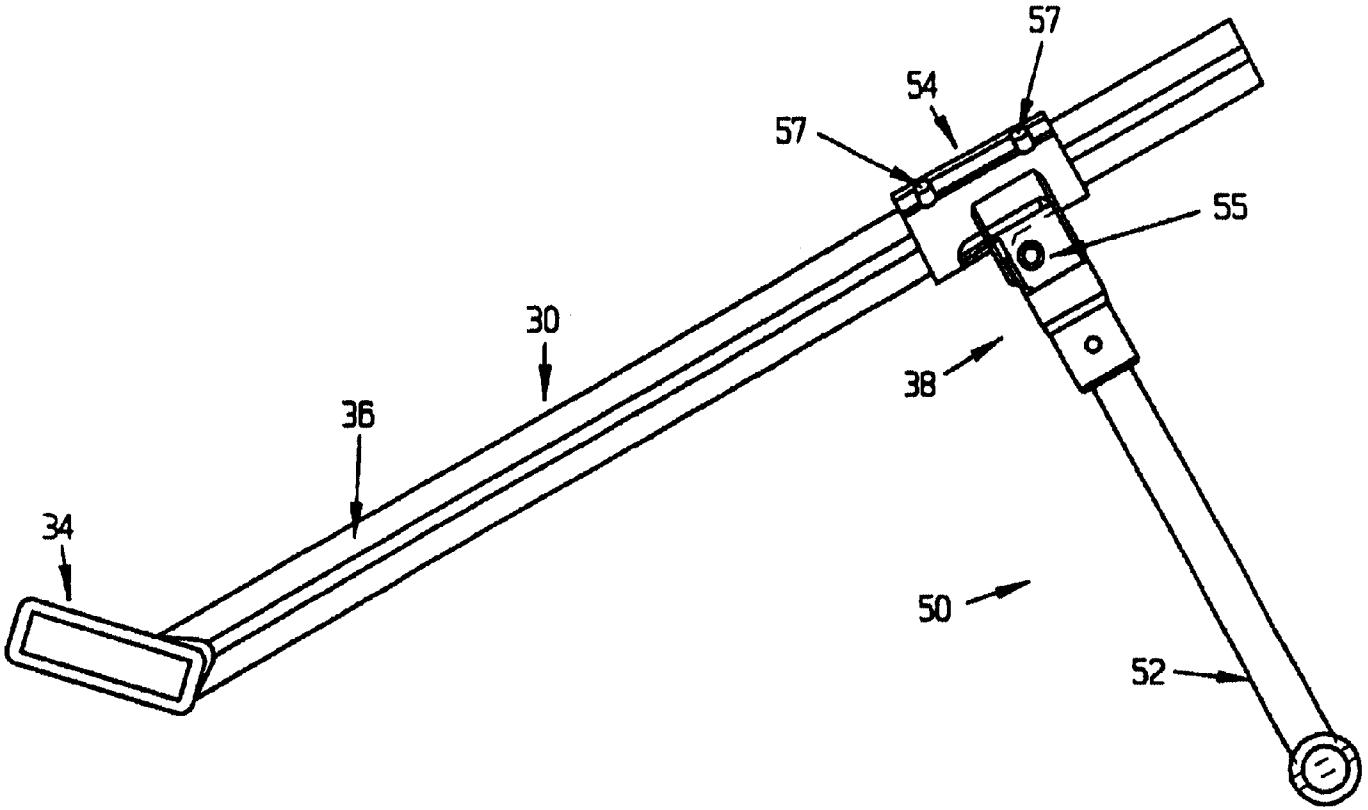
Figure 8:
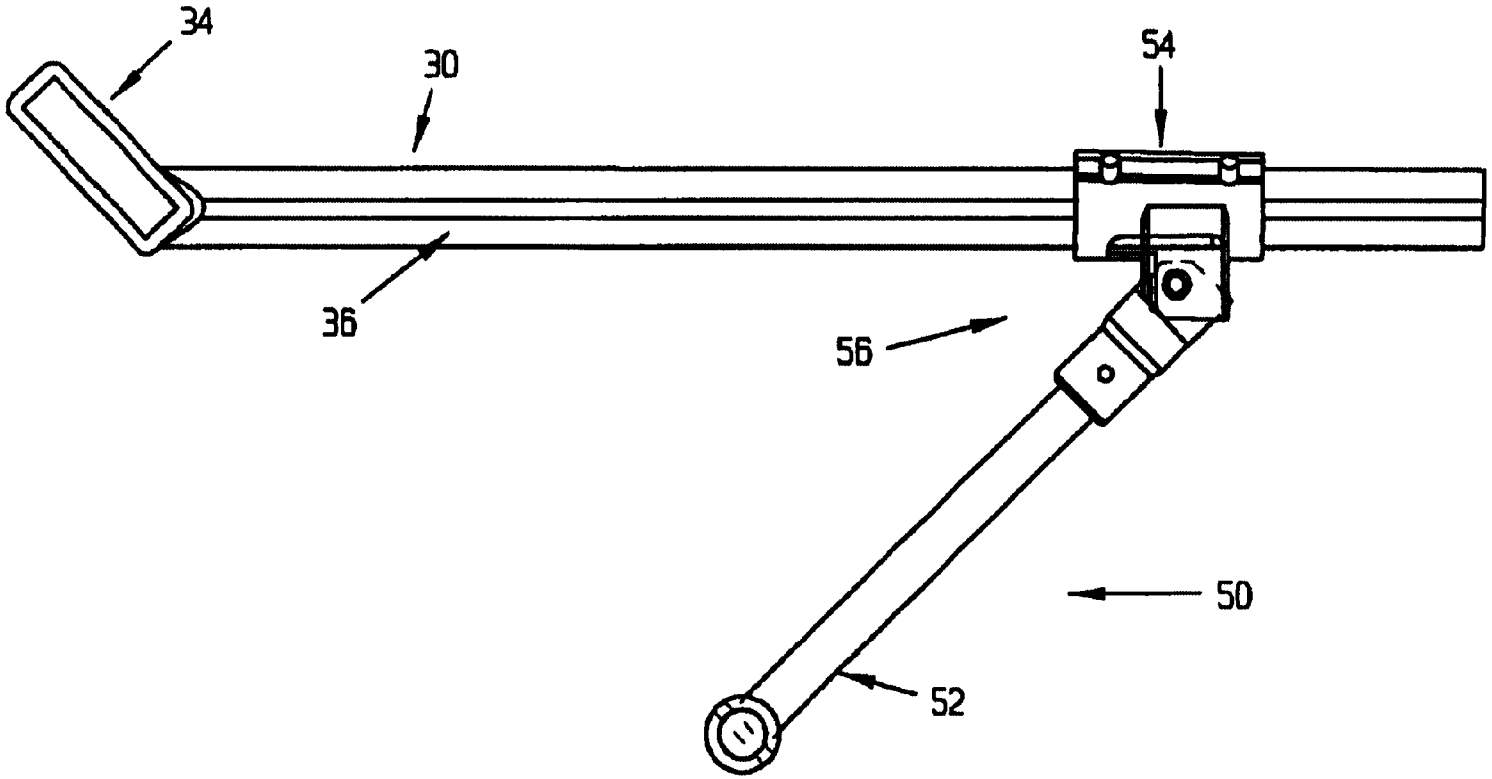
FIG. 8 illustrates a view of the delivery accessory in the released position allowing the accessory to slide along the broom handle.
Figure 9:
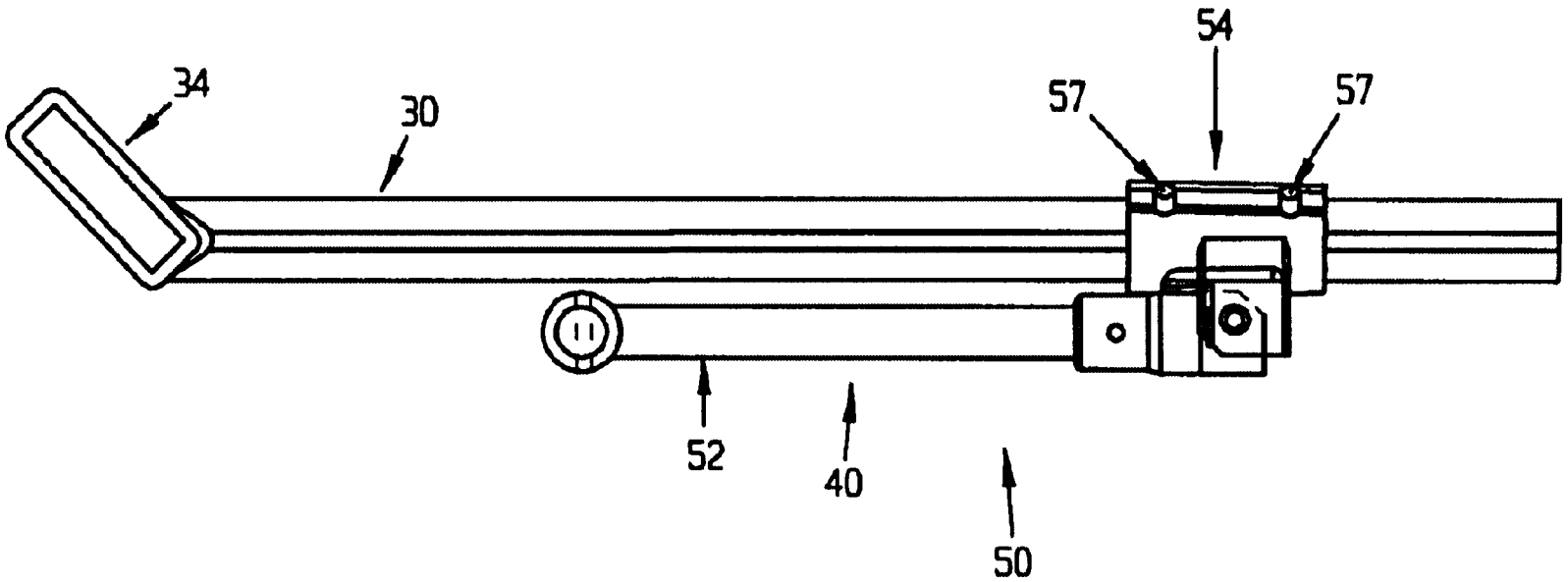
Figure 10:
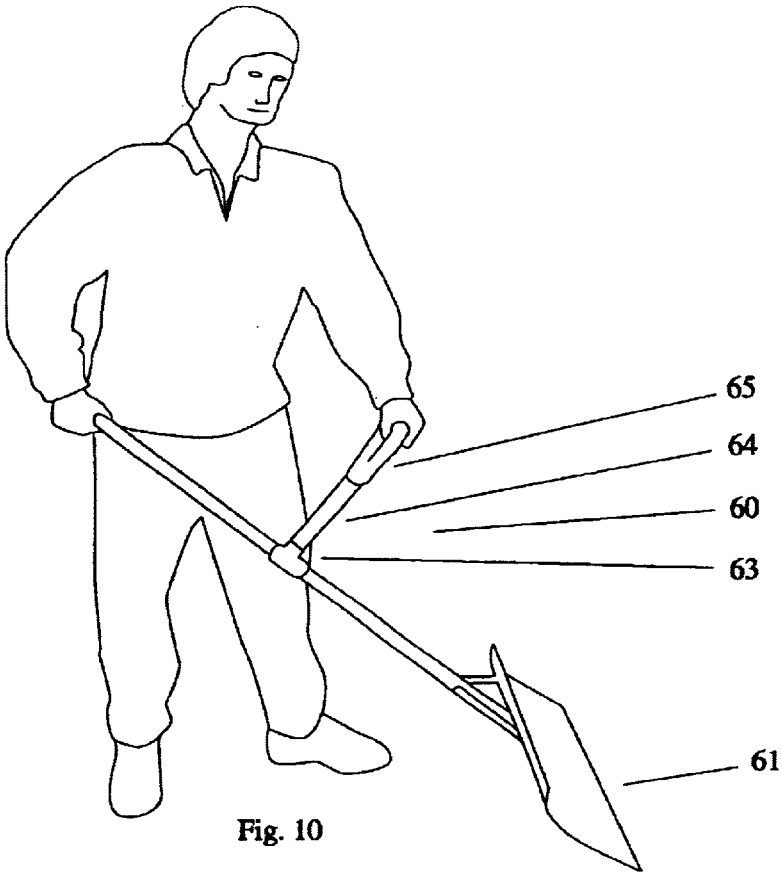
FIG. 10 illustrates an alternative embodiment of the apparatus of the invention used in conjunction with a snow shovel.
Figure 11:
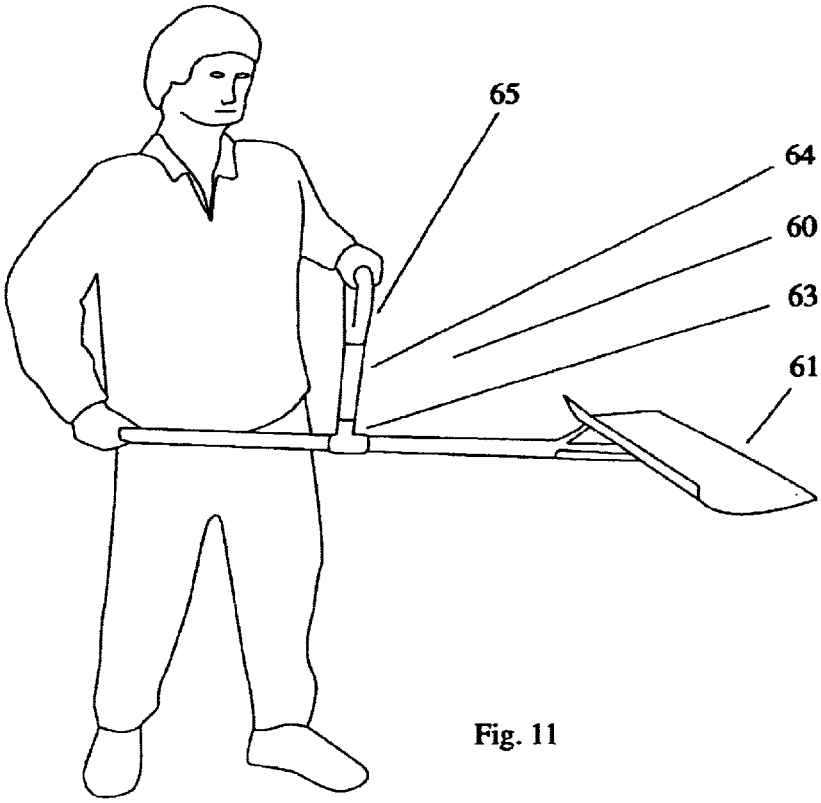
FIG. 11 illustrates the apparatus of FIG. 10 where the user lifts the shovel utilizing the apparatus.
Figure 12:
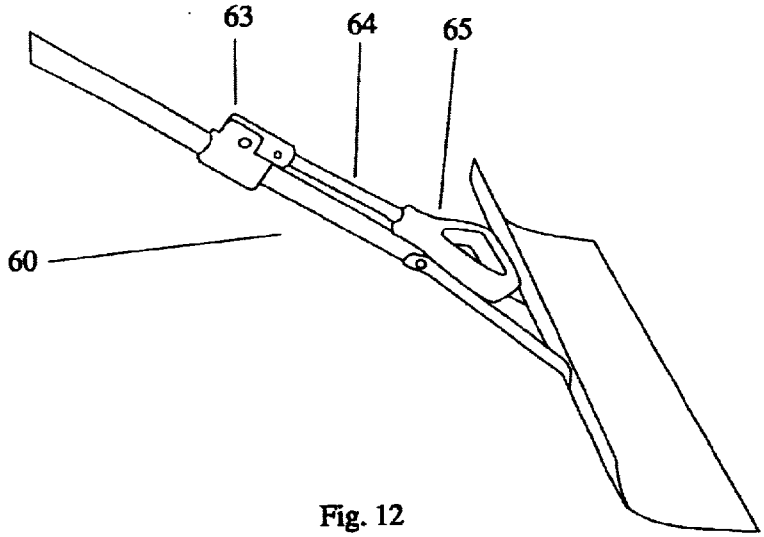
FIG. 12 illustrates the apparatus of FIGS. 10 and 11, where the apparatus is oriented in a storage position with the shovel.
Figure 13:
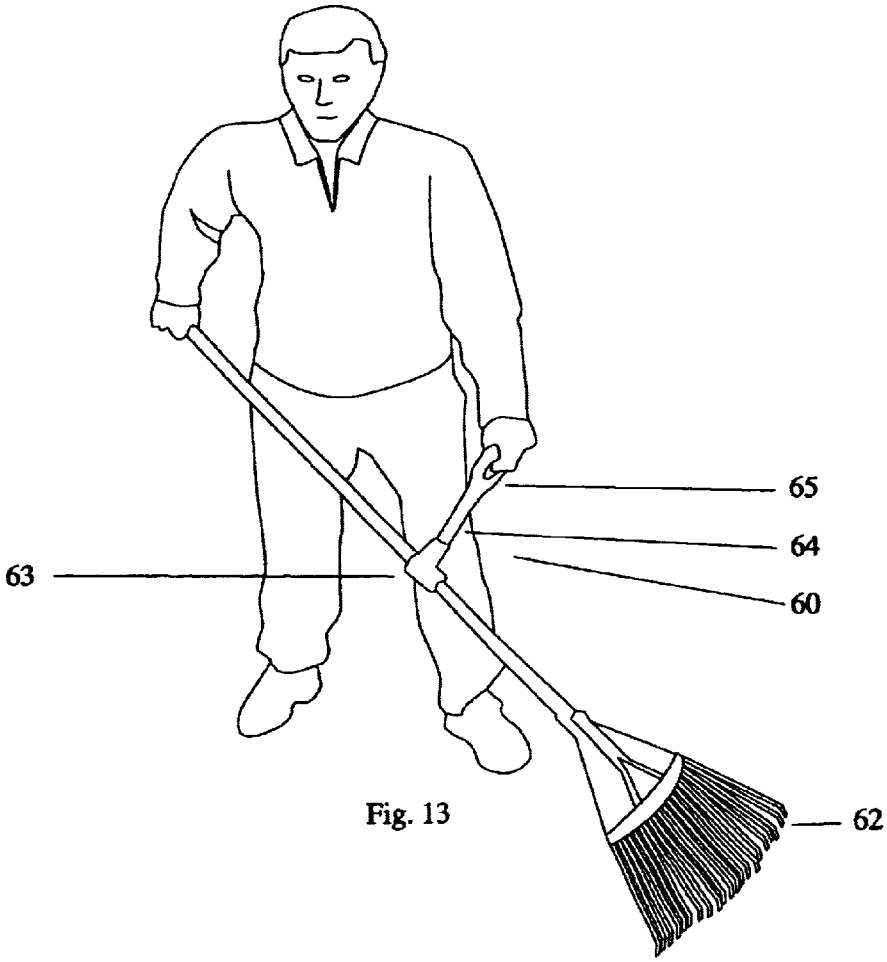
FIG. 13 illustrates the apparatus of FIGS. 10–12 used in conjunction with a rake.

As shown in FIG. 7, the delivery accessory 50 includes a friction cam 55 adapted for locking into a useable orientation in the first position 38, releasing, FIG. 8, 56 to slide along the broom handle 36 between the two positions 38 and 40, and locking into a stored orientation into the second position FIG. 9, 40. In the locked first and second positions 38 and 40, the cam 55 presses against the broom handle 36 with a force sufficient to prevent the delivery accessory 50 from sliding or otherwise moving on the broom handle 36.

The delivery accessory 50 for a curling broom 30 generally comprises a support stand 52 and a mount 54 adapted for attaching the support stand 52 to the curling broom 30. The mount 54 preferably is adjustably attached along a length of a curling broom handle 36 by means of four set screws 57. The support stand 52 has an adjustable length to accommodate different delivery styles and different player sizes.

The method for delivering a curling stone generally comprises the steps of moving the delivery accessory into the delivery position 38, and delivering the curling stone with one hand and holding onto the curling broom with a second hand as the curling stone is being delivered. The method may further comprise the step moving the delivery accessory from the delivery position 38, after the curling stone is delivered, and repositioning the delivery accessory in a nonobtrusive position 40 enabling the curling broom the be used for conventional sweeping.

It is anticipated the other embodiments may be made within the teachings of this present invention. For example, the delivery accessory may be designed to be retrofitted onto an existing broom handle, or the broom handle may be specifically designed to include a delivery accessory or to be modifiable to form a delivery accessory. For example, it is anticipated that the broom handle could be hinged in such a manner as to form a delivery accessory from a portion of the broom handle. Additionally, the delivery accessory may comprise, as shown, a mount and a support stand or otherwise may include a number of different elements. Preferred materials include light metal or plastic, although other materials may be used.

Referring to FIGS. 10–13, an alternative embodiment of the accessory 60 is shown used in conjunction with a shovel 61 (a snow shovel in particular) and a rake 62 (a leaf rake in particular). The accessory 60 may also be used as a support device for metal detectors, and other tools or instruments. The apparatus 60 includes an adjustable, releasable mount 63, a shaft 64 of a predetermined length connected to the mount 63, and a handle 65 connected to the shaft 64 at the opposite end of the mount 63.

The descriptions above and the accompanying drawings should be interpreted in the illustrative and not the limited sense. While the invention has been disclosed in connection with an embodiment or embodiments thereof, it should be understood that there may be other embodiments which fall within the scope of the invention as defined by the claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

The invention claimed is:

1. A curling broom, comprising:

(a) a broom head;

(b) a broom handle attached to said broom head; and (c) a delivery accessory adapted for being attached to either said broom handle or said broom head in both a first position and a second position, said delivery accessory improving the balance of a person delivering a curling stone in said first position enabling said curling broom to be used for conventional sweeping in front of a delivered curling stone wherein said delivery accessory includes a friction cam adapted for locking into a useable orientation in said first position, releasing to slide between said first position and said second position along said broom handle, and locking into a stored orientation in said second position.

2. The curling broom of claim 1, wherein said delivery accessory is adapted or being attached to said broom handle in said first position.

3. The curling broom of claim 2, wherein said delivery accessory has an adjustable length.

4. The curling broom of claim 2, wherein said broom handle has a length and said delivery accessory is adapted for being adjustably attached along said length of said broom handle.

5. The curling broom of claim 1, wherein said delivery accessory is adapted for being attached to said broom handle in said second position.

6. The curling broom of claim 1, wherein said broom handle is hollow with an end opening, and said delivery accessory is adapted for being inserted into said broom handle in said second position.

* * * * *